US006361364B1

(12) United States Patent
Holland et al.

(10) Patent No.: US 6,361,364 B1
(45) Date of Patent: Mar. 26, 2002

(54) SOLDERLESS CONNECTOR FOR A COAXIAL MICROCABLE

(76) Inventors: Michael Holland, 107 Via Del Cielo, Santa Barbara, CA (US) 93109; Shen Chia Wong, No. 5, Lane 425, Sec. 4, Chung Yang N Road, Peito District, Taipei (TW)

( * ) Notice: Subject to any disclaimer, the term of this patent is extended or adjusted under 35 U.S.C. 154(b) by 0 days.

(21) Appl. No.: 09/798,104

(22) Filed: Mar. 2, 2001

(51) Int. Cl.[7] ..... H01R 9/05
(52) U.S. Cl. ..... 439/578
(58) Field of Search ..... 439/578, 582, 439/583, 584, 585, 827

(56) References Cited

U.S. PATENT DOCUMENTS 2,225,728 A * 12/1940 Weidenman, Sr. ..... 439/578
3,954,321 A * 5/1976 Casper ..... 439/582
3,995,930 A * 12/1976 Herrmann, Jr. ..... 439/582
4,360,244 A * 11/1982 Forney, Jr. et al. ..... 439/582
6,109,963 A * 8/2000 Follingstad et al. ..... 439/578
6,179,656 B1 * 1/2001 Wong ..... 439/578
6,254,430 B1 * 7/2001 Endo et al. ..... 439/578

FOREIGN PATENT DOCUMENTS

DE 3712693 A1 * 10/1988 ..... 439/578

* cited by examiner

*Primary Examiner*—Tho D. Ta
(74) *Attorney, Agent, or Firm*—Michael G. Petit

(57) ABSTRACT

The invention describes a method of electrically and mechanically connecting the center conductor of a micro-coaxial RF cable to a coaxial cable connector or bulkhead without the use of traditional soldering or precision tools. The device is essentially a solderless, crimpless connector. The invention allows a cable installer to connect a micro-coaxial cable having a central conductor as small #30 AWG (0.25 mm) to a coaxial cable connector under field conditions. The invention employs a two-stage, spring loaded center pin holding device and a method for using the device to facilitate easy field installation while maintaining mechanical and electrical reliability.

2 Claims, 3 Drawing Sheets

PRIOR ART
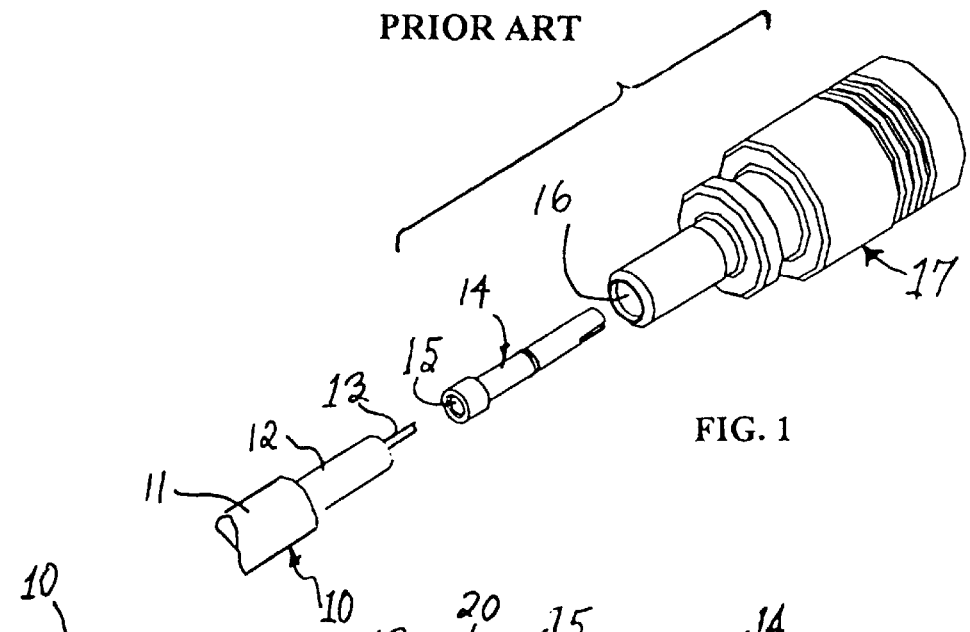
FIG. 1
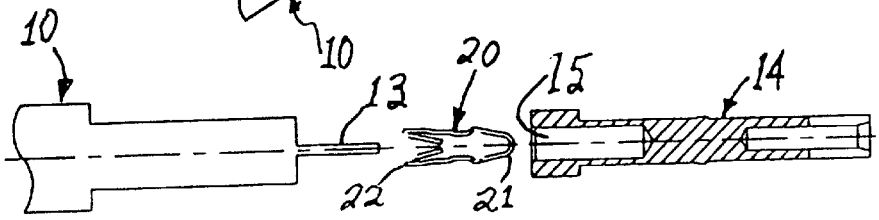
PRIOR ART FIG. 2 PRIOR ART
FIG. 3
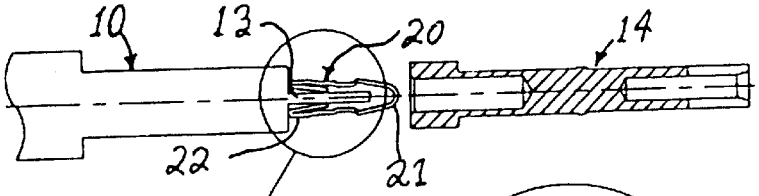
FIG. 4
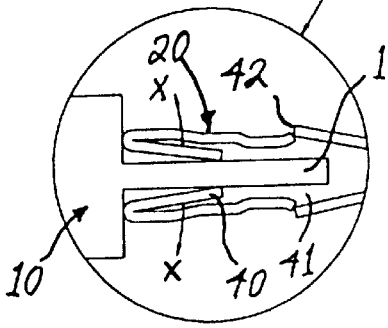
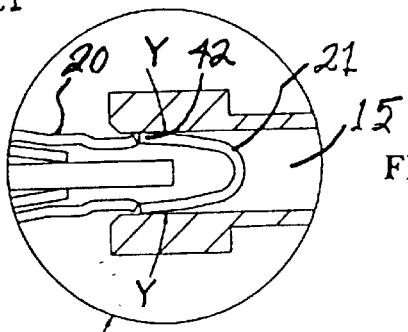
FIG. 6
FIG. 5
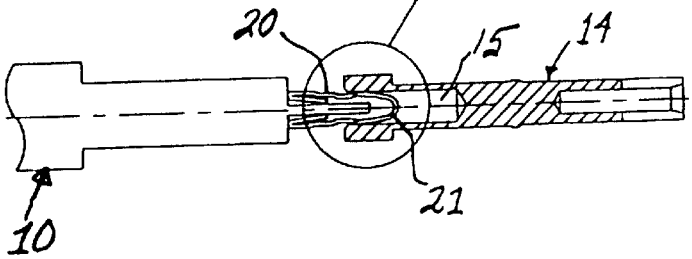

FIG. 7
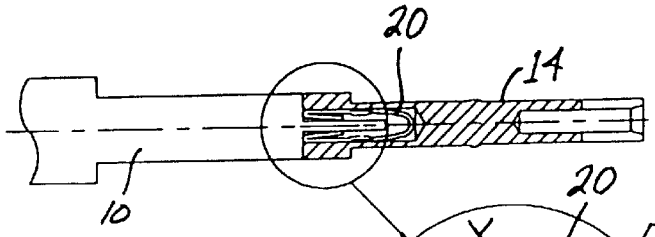
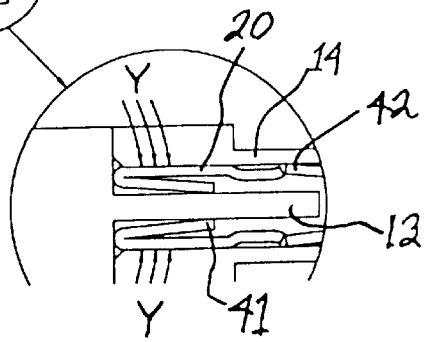
FIG. 8
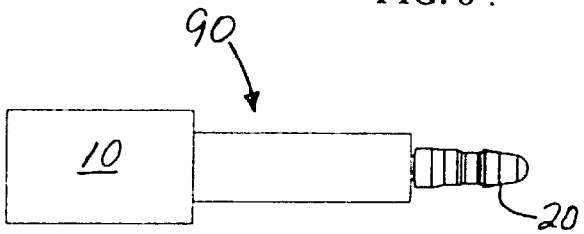
FIG. 9
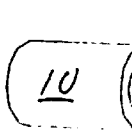
FIG. 10
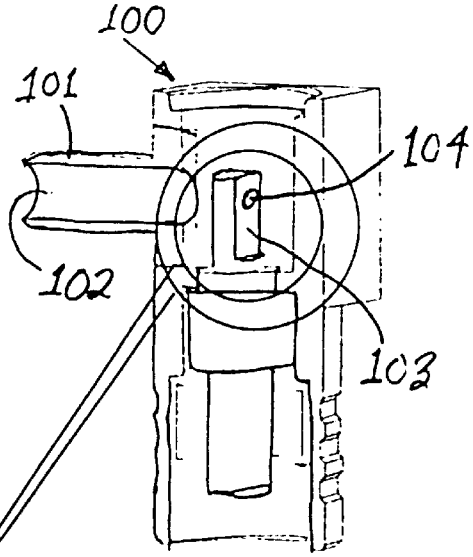
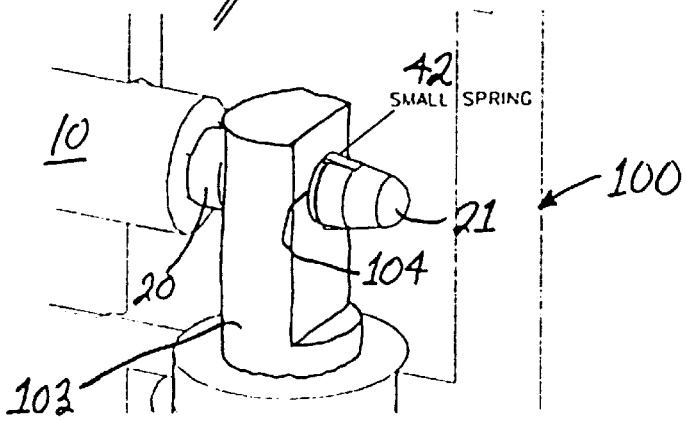
FIG. 11

SOLDERLESS CONNECTOR FOR A COAXIAL MICROCABLE

BACKGROUND OF THE INVENTION

1.Field of the Invention

2. Prior Art

In signal transmission applications, the choice of coaxial cable for conducting the signal is usually determined by the distance between connection points, the signal frequency, the maximum bend radius required, and the connector space available in a particular transmitting and/or receiving device. The longer the cable and the higher the frequency used, the larger the outside diameter needs to be to prevent excessive signal loss. Traditional coaxial cable applications such as Cable TV, Broadband data, and microwave signal transmission, employ coaxial cables with O.D.'s of 0.25–1 inches for distances of 50–1000 feet. In indoor equipment, the shorter distance requirements (typically 6–24 inches), the limitations of limited space and tighter bend radius requirements are overcome by using smaller coaxial cables with O.D.'s of 0.1–0.14 inches. These small OD cables typically require the use of precision micro-connectors such as SMA, SMB and MCX, which must be connected to the cable in a more or less controlled setting such as a laboratory with precise equipment to both hold and electrically attach the cable to the connectors. The central conductor for such microcoaxial cables is usually attached to the connector by either soldering directly to a fixed center pin in the connector, or soldering or crimping the central conductor to a separate small center pin which is then inserted into the connector. The soldering method requires both electricity, and a clean, well lighed area for assembly. The use of small separate center pins, with a diameter of about 0.040 inch, need careful handing and holding during assembly. The installer needs to hold the pin, place it over the cable center conductor, and then perform the solder or crimp procedure.

With the increased demands on broadband network centers and field located hubs, there exists a need for higher density coaxial cable bundles having as many as 200 coaxial cables connected between equipment locations 100 feet apart. These new high-density cable assemblies now require field-installable connectors that are installed in lab environments. The high-density equipment backplanes also require microcoaxial cable connectors rather than larger connectors used when only a few low density cables are involved. The new cable requirements have been met with the development of lower loss microcoaxial cable bundles containing as many as 12 coaxial cables (each with a 0.1 in. OD) within in a 0.45 inch diameter jacket. There is a need for a reliable method of attaching these microcoaxial cable connectors to the microcoaxial cables in the field without the need for soldering and special handling equipment. A problem encountered during field installation of microcoaxial cable connectors is chemical contamination of conductive parts of the assembly from the installer's hands. Precision microcoaxial cable connectors are usually plated with gold to limit oxidation and thus require a level of cleanliness to insure proper performance. It is very difficult to insure this level of clean handling when the installer is required to manually grasp the connection center pin in the microcoaxial connector during installation.

Coaxial cables with larger center conductors of over 0.031 in. (0.8 mm) usually use the central conductor as the male center pin within the (assembled) male connector. The central conductor is then inserted directly into the female receptacle that comprises a mating seizing pin. Smaller cables require a male pin to first be attached to the (smaller) central conductor in order to confer the rigidity to the male pin needed to overcome the insertion force required for mating engagement with the female receptacle. Even with additional fixed center pins, the insertion force required for secure engagement can still be limited by the weaker section of the small central conductor not supported by the larger fixed pin.

Coaxial cable connector construction and installation is well known in the established art. The present inventor, in copending U.S. patent application Ser. No. 09/599,059, filed Jun. 21, 2000, U.S. Pat. No. 6,217,383 discloses a compression-type coaxial cable connector. The connector, and each of the components associated therewith, has an axial conduit coextensive with the length thereof. When the prepared end of a coaxial cable is advanced through the conduit into the body portion, a shank separates the outer protective jacket and conductive braid of the cable from the dielectric core and interposes the barbed portion of the tubular shank therebetween. A compression sleeve, with the assistance of a compression tool, compresses the cable jacket and braid providing secure attachment.

Stirling, in U.S. Pat. No. 5,007,861, discloses a crimpless coaxial cable connector which can be secured to a cable simply by pushing the cable into the connector and subsequently pulling it back. The body of the connector has a bushing mounted within it near the cable-receiving end having a conduit dimensioned to receive the cable. The body of the connector also has within it an annular mandrel having a bore to receive the stripped core of the cable, and having a sleeve adapted to engage the cable beneath the jacket by pushing the cable and the mandrel together.

Another radial compression type of coaxial cable connector of the type generally used today for forming an electrical connection between a central conductor within the coaxial cable and a mating fixture is described in detail in U.S. Pat. No. 5,632,651 to Szegda. Various other coaxial cable connectors adapted to from a secure, electrically conductive connection between a coaxial cable and a threaded female port have been developed. Such prior art connectors are discussed, for example, in U.S. Pat. No. 5,024,606 to Ming-Hua, U.S. Pat. No. 4,280,749 to Hemmer, U.S. Pat. No. 4,593,964 to Forney, Jr. et al., U.S. Pat. No. 5,073,129 to Szegda and U.S. Pat. No. 5,651,699 to Holliday. U.S. Pat. No. 5,879,191 to Burris, discusses prior art efforts to provide a coaxial connector which is moisture-proof and minimizes radiative loss of signal from the cable.

All of the above-referenced connectors require that a stripped length of the coaxial cable' central conductor project from the end of the cable within the axial bore in the connector for engagement with a conductive receptacle in the mating fixture. The prior art connectors work well with standard coaxial cables having a relatively large gauge central conductor because the stripped length is rigid. The rigid conductor can be forced into a spring receptacle in a mating fixture without difficulty. Microcoaxial cables, however, have a small, fragile central conductor. The stripped length of the central conductor in a microcoaxial cable lacks the structural integrity for insertion into a conductive receptacle in a mating fixture. It is current practice to solder or crimp an electrically conductive cap over the stripped length of central conductor in order to provide sufficient rigidity to the central conductor for use with standard connector assemblies. Accordingly, there is a current need for a solderless device and method for adapting the central conductor of a microcoaxial cable for use with standard coaxial cable connectors without the need for soldering or precision crimping.

SUMMARY

It is a primary object of the invention to provide a facile means for imparting rigidity to a stripped length of central conductor in a microcoaxial cable.

It is a further object of the invention to provide a facile means for imparting rigidity to a stripped length of central conductor in a microcoaxial cable without requiring either soldering or precision crimping.

It is yet a further object of the invention to provide an electrically conductive pin adapted to fit snugly over a stripped length of a central conductor of a microcoaxial cable, thereafter seizing the central conductor in locking engagement therewith.

It is another object of the invention to provide a tool operable for the facile attachment of an electrically conductive pin to the stripped central conductor of a microcoaxial cable.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

BRIEF DESCRIPTION OF THE DRAWINGS

FIG. 1 is an exploded perspective view of a microcoaxial cable-connector assembly in accordance with a first preferred embodiment of the present invention.

FIG. 2 is a partially cross-sectional view of first and second pins in accordance with a first preferred embodiment of the present invention prior to attachment of the pins to the central conductor of a microcoaxial cable.

FIG. 3 is a partially cross-sectional view of first and second pins in accordance with a first preferred embodiment of the present invention with the first pin attached to the central conductor of the microcoaxial cable in preparation for attachment of the first pin to the second pin.

FIG. 4 is an enlarged view of a portion of FIG. 3 showing the seizing and locking engagement between the first pin and the central conductor of a microcoaxial cable.

FIG. 5 is a partially cross-sectional view of the first pin partially inserted into an axial recess in the trailing end of the second pin.

FIG. 6 is an enlarged view of a portion of FIG. 5 showing the seizing and locking engagement between the first pin and the second pin with the first pin partially inserted into the an axial recess in the trailing end of the second pin.

FIG. 7 is a partially cross-sectional view of the first pin fully inserted into the axial recess in the trailing end of the second pin in preparation for inserting the cable-pins assembly into a microcoaxial cable connector (not shown).

FIG. 8 is an enlarged view of a portion of FIG. 7 showing the seizing and locking engagement between the central conductor of the microcoaxial cable and the first pin and between the first pin and the second pin with the first pin fully inserted into the axial recess in the trailing end of the second pin.

FIG. 9 is a side elevational view of the leading end of a microcoaxial cable with the first pin of the present invention attached to the central conductor.

FIG. 10 is a partially cutaway view of a right angle coaxial cable connector adapted to receive a microcoaxial cable having a first pin attached thereto in accordance with a second preferred embodiment of the present invention.

FIG. 11 is an enlarged view of a portion of the right angle coaxial cable connector of FIG. 10 showing the locking engagement between an electrically conductive element in the connector and the first pin.

DESCRIPTION OF THE PREFERRED EMBODIMENTS

Figure 12:
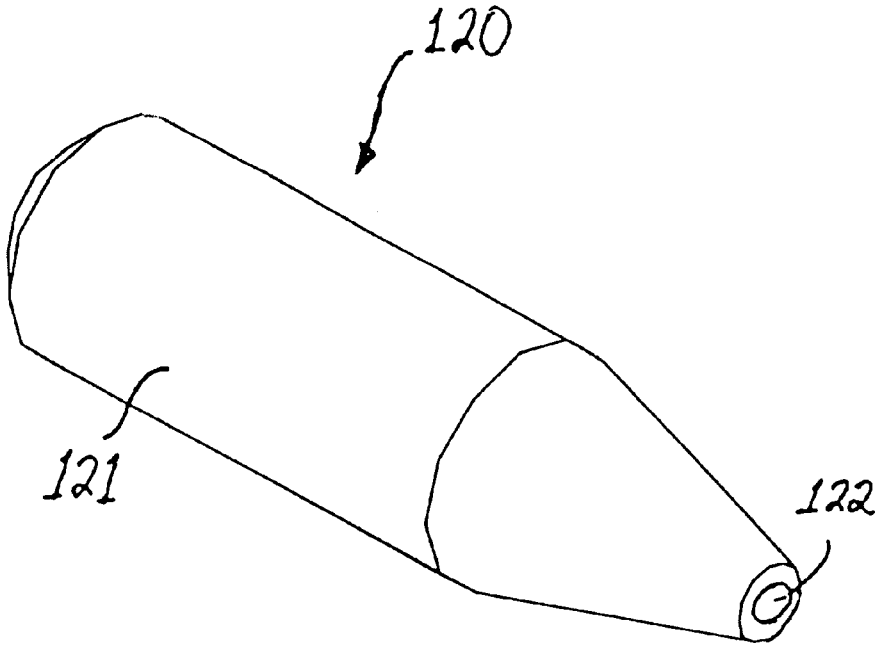
FIG. 12 is a perspective view of a hand-holdable tool useful for inserting the first pin over a stripped portion of the central conductor of a microcoaxial cable.

With reference to FIG. 1, a partially exploded view of a microcoaxial cable-connector assembly is shown, illustrating the current state of the art for microcoaxial cable connection. The term "microcoaxial cable", as used herein, means a coaxial cable, such as RG179 cable, having a central conductor diameter less than 0.8 mm. and greater than about 0.1 mm. A prior art microcoaxial cable 10 has an outer jacket 11, an underlying layer of a dielectric material 12 and a central conductor 13. A microcoaxial cable connector 17 in accordance with the prior art includes a second pin 14 dimensioned to fit within an axial conduit 16 in the connector 17. The second pin 14 has a trailing end with a cylindrical recess 15 therewithin. In accordance with the prior art, the second pin 14 is soldered or crimped to the stripped length of central conductor 13.

Turning now to FIGS. 2–8, the present invention provides an electrically conductive first pin 20 having a leading end 21 and a hollow trailing end 22 is shown in side cross-sectional view interposed between the stripped central conductor 13 of the microcoaxial cable 10 and the second pin 14 of the connector 17. The first pin 20 has a first spring barb 40 (FIG. 4) adjacent the hollow recess 41 within the first pin. When the central conductor 13 is inserted into the hollow recess 41 in the first pin and advanced thereinto, the first spring barb 40 is forced outwardly in the direction of the arrows X, and seizes the central conductor to prevent retraction or removal of the first pin from the central conductor. After the first pin is attached to the central conductor of the microcoaxial cable, as shown in FIGS. 3 and 4, the leading end 21 of the first spring 20 is inserted into the cylindrical recess 15 in the trailing end of the second pin as shown in FIGS. 5 and 6. Advancement of the first pin into the cylindrical recess 15 in the second pin compresses second spring barbs 42 on the outer surface of the first pin in the direction of arrows Y, preventing removal of the first pin from the recess 15 as shown in FIG. 7 and in greated detail in FIG. 8. The second pin 14, thus affixed to the central conductor and in electrical communication therewith, is then inserted into the axial conduit 16 in the prior art connector 17 and locked thereto by conventional cable attachment means. The rigidity of the second pin enables the cable connector assembly to be affixed to a mating fixture without damaging the central conductor or compromising the structural integrity of the electrical connection.

A right angle coaxial cable connector, such as illustrated at numeral 100 in partially cutaway view in FIG. 10, is commonly used in the art where space considerations dictate. The right angle coaxial cable connector 100 includes a cable receiving port 101 having an axial cylindrical conduit 102 therein dimensioned to receive a coaxial cable, an electrically conductive connector post 103 having a hole 104 therein. The hole 104 is is disposed on the connector post 103 coaxially with the axial conduit 102. In a second preferred embodiment of the present invention, the first pin 20 is inserted over a stripped length of a microcoaxial cable central conductor as shown in FIG. 9. The cable-first pin assembly 90 is then inserted into the conduit 102 in the cable receiving port 101 and advanced thereinto until the leading end 21 and the second spring barb 42 on the first pin 20 pass through the hole 104 in the connector post 103. The spring barb 42 prevents retraction of the microcoaxial cable from the connector 100, as shown in greater detail in FIG. 11.

Figure 13:
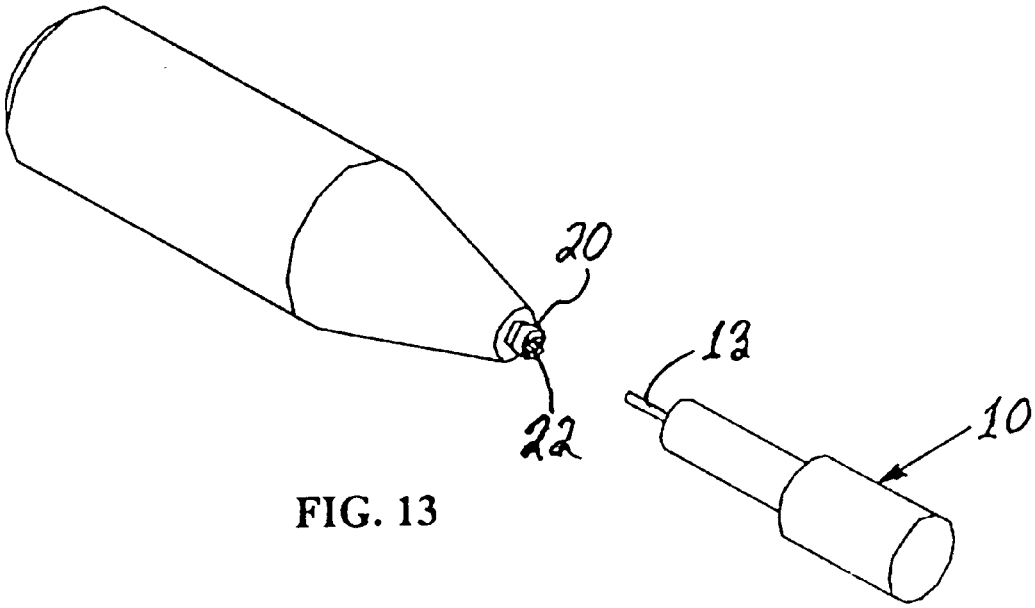
FIG. 13 is a perspective view showing the relationship between the hand-holdable tool of FIG. 12, a first pin in accordance with the present invention and a stripped portion of the central conductor of a microcoaxial cable prior to attaching the first pin to the central conductor.

As mentioned earlier, handling of the conductive elements comprising the microcoaxial cable-connector assembly can leave an oxidizing residue thereon that con be detrimental to electrical conduction and lead to electrical failure. Accordingly, a first pin installation tool is provided as shown at numeral 120 in FIG. 12. The tool 120 includes a handle 121 having a cylindrical recess 122 in a leading end thereof. The cylindrical recess 122 is dimensioned to house the leading end 21 of the first pin 20 without compressing the second spring barbs 42 on the outer surface of the first pin. In order to attach the first pin 20 to the central conductor 13 of a cable 10, shown in FIG. 13, the leading end of the first pin is inserted into the cylindrical recess 122 where it is held snugly but without substantial compression. The stripped length of the central conductor 13 is inserted into the hollow recess in the trailing end 22 of the first spring and advanced thereinto until it cannot be further advanced. The cable 10 is then retracted from the tool 120 with the first pin securely attached to, and in electrical connection with, the central conductor. The resulting assembly can then be used for facile attachment to a microcoaxial cable connector as discussed hereinabove.

In summary, the present invention overcomes the need for hand contact with the conductive elements in a microcoaxial cable-connector assembly and provides means for conferring rigidity to a stripped length of a central conductor by the use of the dual holding pin system. The small center conductor is first inserted into a low insertion force seizing pin, preferably contained in a large plastic hand holder. The larger plastic pin holder is then removed leaving the first seizing pin affixed to the central conductor. The first pin is then inserted into a second seizing pin located within the connector, providing additional compressive force between the central conductor and the first pin. In order to insert the first pin into the second without bending the center conductor, the first pin is supported through contact with exposed face of the dialectic layer around the center conductor. This method also eliminates the problem found in connectors with crimp-on center pins. The method of crimp-on center pins is not usually attempted with microcoaxial cable conductors as small as 0.25 mm OD such as are found in the new microcoaxial cables. Until now, the only reliable attachment method for these small cables has been soldering which has inherent craftsmanship limitations when installed in the field. The invention provides a device and method which allows the first pin to be pushed into the second forming a complete system. Upon insertion into the second pin (inside the connector) the first pin is compressed further to provide a reliable holding force and locked to prevent withdrawal. After insertion of the thus prepared microcoaxial cable into the connector, the outer jacket of the cable is crimped to the connector using traditional crimp tools.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What we claim is:

1. A microcoaxial cable connector adapted for attachment to a microcoaxial cable having an outer jacket, a dielectric layer underlying the outer jacket and a central conductor having a stripped portion, the microcoaxial cable connector comprising:

(a) a connector pin comprising an elongate, electrically conductive member having a leading end and a trailing end with a cylindrical recess therewithin; and (b) a locking pin comprising an elongate electrically conductive member having a leading end adapted to fit within and lockingly engage said cylindrical recess in said connector pin, and a trailing end adapted to movably receive the stripped portion of the central conductor therewithin and lockingly engage the stripped portion of the central conductor of the microcoaxial cable when the leading end of the locking pin lockingly engages the cylindrical recess in said connector pin.

2. A locking pin for use with a microcoaxial cable connector, the microcoaxial cable connector being adapted for attachment to a microcoaxial cable having a central conductor, a portion of the central conductor being stripped, the microcoaxial cable connector having a center pin comprising a cylindrical, electrically conductive member having a cylindrical recess in one end thereof dimensioned to receive the stripped portion of the central conductor therewithin, said center pin being operable for establishing electrical connection between the central conductor and an electrically conductive receptacle in a mating fixture, the locking pin comprising an elongate, electrically conductive member having a conical leading end with a spring barb projecting outwardly from an outer surface thereof, said leading end and said spring barb being dimensioned to fit snugly within the cylindrical recess in the center pin, and a trailing end having a cylindrical locking pin recess therein with a spring barb projecting inwardly from an inner cylindrical surface of said locking pin recess, said locking pin recess being dimensioned to receive and movably contain the stripped portion of the central conductor therewithin, and wherein said trailing end of said locking pin defines an annulus that abuts a dielectric layer of the microcoaxial cable adjacent to the stripped portion of the central conductor when the stripped portion of the central conductor is fully advanced into said cylindrical locking pin recess within said trailing end of said locking pin, said full advancement of said locking pin into said cylindrical locking pin recess urging said spring barb into locking engagement with said central conductor.

* * * * *